US007624795B1

(12) United States Patent
Bangash et al.

(10) Patent No.: US 7,624,795 B1
(45) Date of Patent: Dec. 1, 2009

(54) BOTTOM MOUNT AUXILIARY PUMPING SYSTEM SEAL SECTION

(75) Inventors: Yasser Khan Bangash, Norman, OK (US); Alan Howell, Oklahoma City, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 327 days.

(21) Appl. No.: 11/429,569

(22) Filed: May 5, 2006

Related U.S. Application Data

(63) Continuation-in-part of application No. 10/459,193, filed on Jun. 11, 2003, now Pat. No. 7,066,248.

(51) Int. Cl.
*E21B 43/00* (2006.01)
*E21B 4/04* (2006.01)

(52) U.S. Cl. ..... 166/105; 166/66.4; 166/68; 417/423.5

(58) Field of Classification Search ..... 166/105, 166/68, 112, 66.4; 417/244, 423.5, 410.1, 417/423.3
See application file for complete search history.

(56) References Cited

U.S. PATENT DOCUMENTS 1,778,787 A 10/1930 Arutunoff
2,236,887 A 4/1941 Arutunoff
2,455,022 A * 11/1948 Schmidt ..... 417/99
3,115,840 A * 12/1963 Feltus ..... 415/199.3
3,404,924 A 10/1968 Choate
3,502,919 A 3/1970 Boyd et al.
3,571,636 A 3/1971 Carle et al.
4,421,999 A 12/1983 Beavers et al.
4,537,257 A 8/1985 Todd
4,541,782 A * 9/1985 Mohn ..... 417/244
4,667,737 A 5/1987 Shaw et al.
4,992,689 A 2/1991 Bookout
5,367,214 A 11/1994 Turner, Jr.
5,979,559 A * 11/1999 Kennedy ..... 166/369
6,033,567 A 3/2000 Lee et al.
6,092,600 A 7/2000 McKinzie et al.
6,167,965 B1 1/2001 Bearden et al.
6,201,327 B1 3/2001 Rivas
6,206,093 B1 3/2001 Lee et al.
6,268,672 B1 7/2001 Straub et al.
6,307,290 B1 10/2001 Scarsdale
6,325,143 B1 12/2001 Scarsdale
6,547,003 B1 * 4/2003 Bangash et al. ..... 166/106
6,811,382 B2 * 11/2004 Buchanan et al. ..... 417/244
2003/0127223 A1 * 7/2003 Branstetter et al. ..... 166/250.15

* cited by examiner

*Primary Examiner*—Kenneth Thompson
(74) *Attorney, Agent, or Firm*—Crowe & Dunlevy

(57) ABSTRACT

Disclosed is a submersible pumping system that includes a motor, a production pump and a seal section disposed between the motor and the production pump. The pumping system further comprises an auxiliary pump disposed below the motor and an auxiliary adapter connected between the motor and the auxiliary pump.

11 Claims, 3 Drawing Sheets

BOTTOM MOUNT AUXILIARY PUMPING SYSTEM SEAL SECTION

RELATED APPLICATIONS

This application is a continuation-in-part of prior application Ser. No. 10/459,193, filed Jun. 11, 2003, entitled Bottom Discharge Seal Section.

FIELD OF THE INVENTION

This invention relates generally to the field of submersible pumping systems, and more particularly, but not by way of limitation, to a seal section for use with a submersible pumping system employing an auxiliary pump.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps located above the motor. When energized, the motor provides torque to the pump, which pushes wellbore fluids to the surface through production tubing. Each of the components in a submersible pumping system must be engineered to withstand the inhospitable downhole environment.

Components commonly referred to as "seal sections" protect the electric motors and are typically positioned between the motor and the pump. In this position, the seal section provide several functions, including transmitting torque between the motor and pump, restricting the flow of wellbore fluids into the motor, protecting the motor from axial thrust imparted by the pump, and accommodating the expansion and contraction of motor lubricant as the motor moves through thermal cycles during operation.

In certain applications, an auxiliary pump can be connected below the motor. Auxiliary pumps can be advantageously employed in applications where a portion or all of the pumping system is located below the perforations in the wellbore. Such a system is disclosed in U.S. Pat. No. 6,666,269, entitled "Method and Apparatus for Producing Fluid From a Well and For Limiting Accumulation of Sediments in the Well," issued Dec. 23, 2003 to Bangash et al. and assigned to the owner of the present application (the "Bangash '269 patent"). As disclosed in the Bangash '269 patent, the auxiliary pump lifts fluids and sediment produced by the formation to a production pump located above the motor. The production pump pushes the fluid and sediment out of the well through production tubing. The auxiliary pump increases fluid flow around the motor, which moderates the temperature of the motor during operation.

The discharge head of the auxiliary pump in the Bangash '269 patent is connected directly to the motor. The auxiliary pump discharge head includes a mechanical seal designed to prevent wellbore fluids from migrating through the auxiliary pump discharge into the motor. Although generally effective, there is a need for alternative designs that can be used to provide additional protection to the motor in certain applications. It is to this and other needs that the present invention is directed.

SUMMARY OF THE INVENTION

Preferred embodiments of the present invention provide a submersible pumping system that includes a motor, a production pump and a seal section disposed between the motor and the production pump. The pumping system further comprises an auxiliary pump disposed below the motor and an auxiliary adapter connected between the motor and the auxiliary pump.

DETAILED DESCRIPTION OF THE PREFERRED EMBODIMENT

Figure 1:
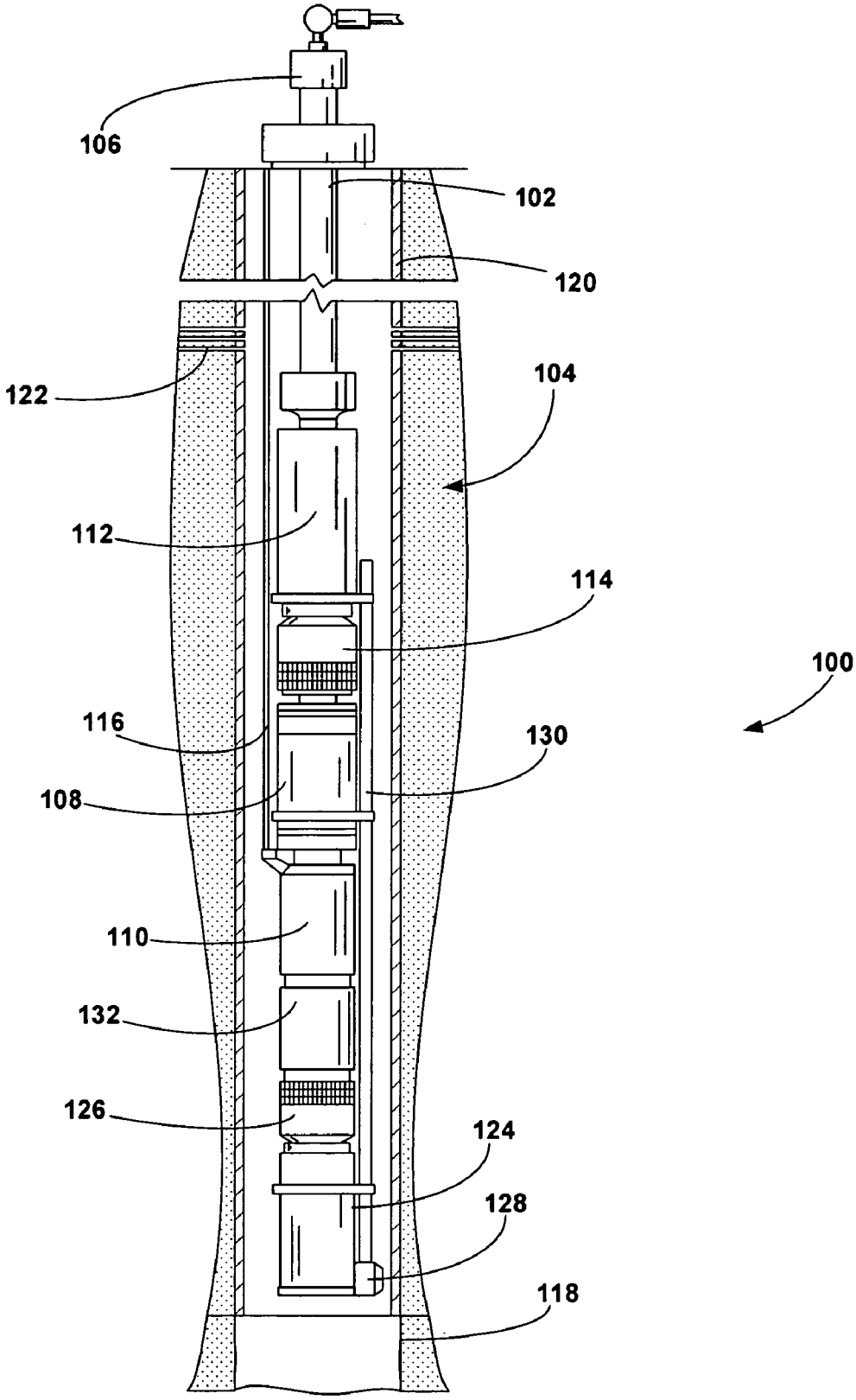
FIG. 1 depicts a submersible pumping system constructed in accordance with a preferred embodiment of the present invention.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface.

The pumping system 100 preferably includes a seal section 108, a motor 110, a production pump 112 and a production pump intake 114. The seal section 108 shields the motor 110 from axial thrust loading produced by the production pump 112 and ingress of fluids produced by the well. The seal section 108 also accommodates expansion and contraction of motor lubricant. The motor 110 is provided with power from the surface by a power cable 116.

Although only one production pump 112 and only one motor 110 are shown, it will be understood that more than one of each can be connected when appropriate. The production pump intake 114 allows wellbore fluids from the wellbore 104 to enter the production pump 112, where the wellbore fluid is forced to the surface through production tubing 102.

As shown in FIG. 1, the pumping system 100 is disposed in the wellbore 104, which has an open rat hole 118, a well casing 120 and perforations 122. The pumping system 100 is disposed in the wellbore below the perforations 122, but above the lower end of the well casing 120. It will be appreciated that the elements of the wellbore 104 are not drawn to scale and that the pumping system 100 may be used in alternate environments. For example, it may be desirable to employ the pumping system 100 in a closed wellbore 104 or above the perforations 122.

Because the production pump intake 114 is located between the perforations 122 and the motor 110, fluids entering the wellbore 104 from the perforations 122 may not be effectively circulated about the motor 110. Without the circulation of wellbore fluids around the motor 110, the motor 110 may overheat or operate inefficiently. Additionally, due to the lack of fluid circulation below the production pump intake 114, sediment in the wellbore fluids may accumulate in the open rat hole 118 and fill-in around the pumping system 100.

To increase the flow of fluid around the motor 110 and limit the accumulation of sediment in the wellbore 104, the pumping system 100 includes an auxiliary pump 124, an auxiliary pump intake 126, an auxiliary pump discharge 128 and an auxiliary pump discharge tubing 130. The auxiliary pump 124 and auxiliary pump intake 126 are located below the motor 110. Wellbore fluids below the motor 110 are drawn into the auxiliary pump 124 through the auxiliary pump intake 126 and forced upward toward the production pump 112. In a particularly preferred embodiment, the auxiliary pump 124 discharges the wellbore fluids above the motor 110 and production pump intake 114 through the auxiliary pump discharge 128 and auxiliary pump discharge tubing 130. Through the operation of the auxiliary pump 124, wellbore fluids are circulated around the lower portions of the pumping system 100. The wellbore fluids and entrained sediment are preferably lifted to a position proximate the production pump intake 114 so that the wellbore fluids and sediment are drawn into the production pump 112 and pumped to the surface.

In the preferred embodiment depicted in FIG. 1, the auxiliary pump 124 is located below the auxiliary pump intake 126. In the alternate embodiment depicted in FIG. 2, the relative positions of the auxiliary pump intake 126 and the auxiliary pump 124 are reversed, with the auxiliary pump 124 located above the auxiliary pump intake 126.

The pumping system 100 also preferably includes a lower seal section 132, which is more specifically referred to herein as an "auxiliary adapter" 132. In the preferred embodiment of FIG. 1, the auxiliary adapter 132 is secured to lower end of the motor 110 and to the upper end of the auxiliary pump intake 126. In the alternate embodiment of FIG. 2, the auxiliary adapter 132 is secured between the motor 110 and the upper end of the auxiliary pump 124. The auxiliary adapter 132 is configured to transmit torque from the motor 110 to the auxiliary pump 124. The auxiliary adapter 132 is designed to protect the motor 110 from axial shock created by the auxiliary pump 124 and to prevent the ingress of wellbore fluids from the auxiliary pump 124 and auxiliary pump intake 126 to the motor 110.

Figure 3:
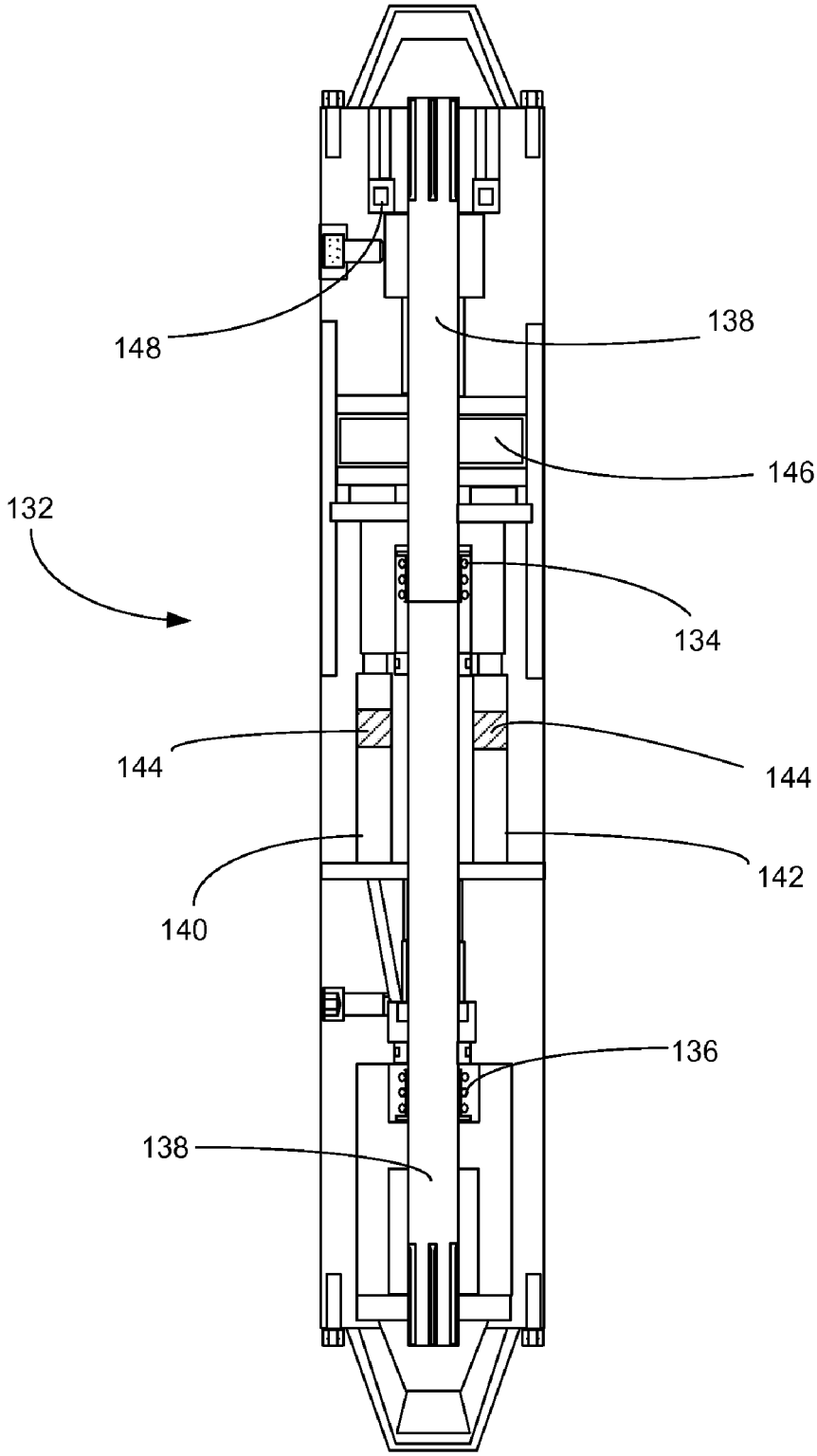
FIG. 3 is a partial cross-sectional view of the auxiliary adapter of the submersible pumping systems of FIGS. 1 and 2.

Turning to FIG. 3, shown therein is a partial cross-sectional view of the auxiliary adapter 132. The auxiliary adapter 132 is preferably fluid-filled and includes mechanical seals 134, 136 along a shaft 138 to discourage the migration of wellbore fluids through the auxiliary adapter 132. If wellbore fluid migrates around the mechanical seals 134, 136, the wellbore fluid is collected in chambers 140 and 142, respectively. The chambers 140 and 142 are also indirectly in fluid communication with the lubricating oil in the motor 110.

To accommodate the expansion and contraction of lubricating oil resulting from the thermal cycles of the motor 110, a set of pistons 144 are provided inside the chambers 140 and 142. The pistons 144 move through the chambers 140, 142 in response to changes in the pressure gradient between the lubricating oil in the motor 110 and the fluid inside the auxiliary adapter 132. In this way, the pistons 144 work in combination with the chambers 140, 142 to create a positive barrier between the fluid in the auxiliary adapter 132 and the motor 110, while permitting the lubricating oil in the motor 110 to expand and contract during operation.

The auxiliary adapter 132 also preferably includes a thrust bearing 146. The thrust bearing 146 offsets axial thrust created by the auxiliary pump 124 which can be translated to the motor 110 along shaft 138. The thrust bearing 146 absorbs much of the shock created by the axial thrust so that the motor 110 is subjected to less thrust and shock.

Figure 2:
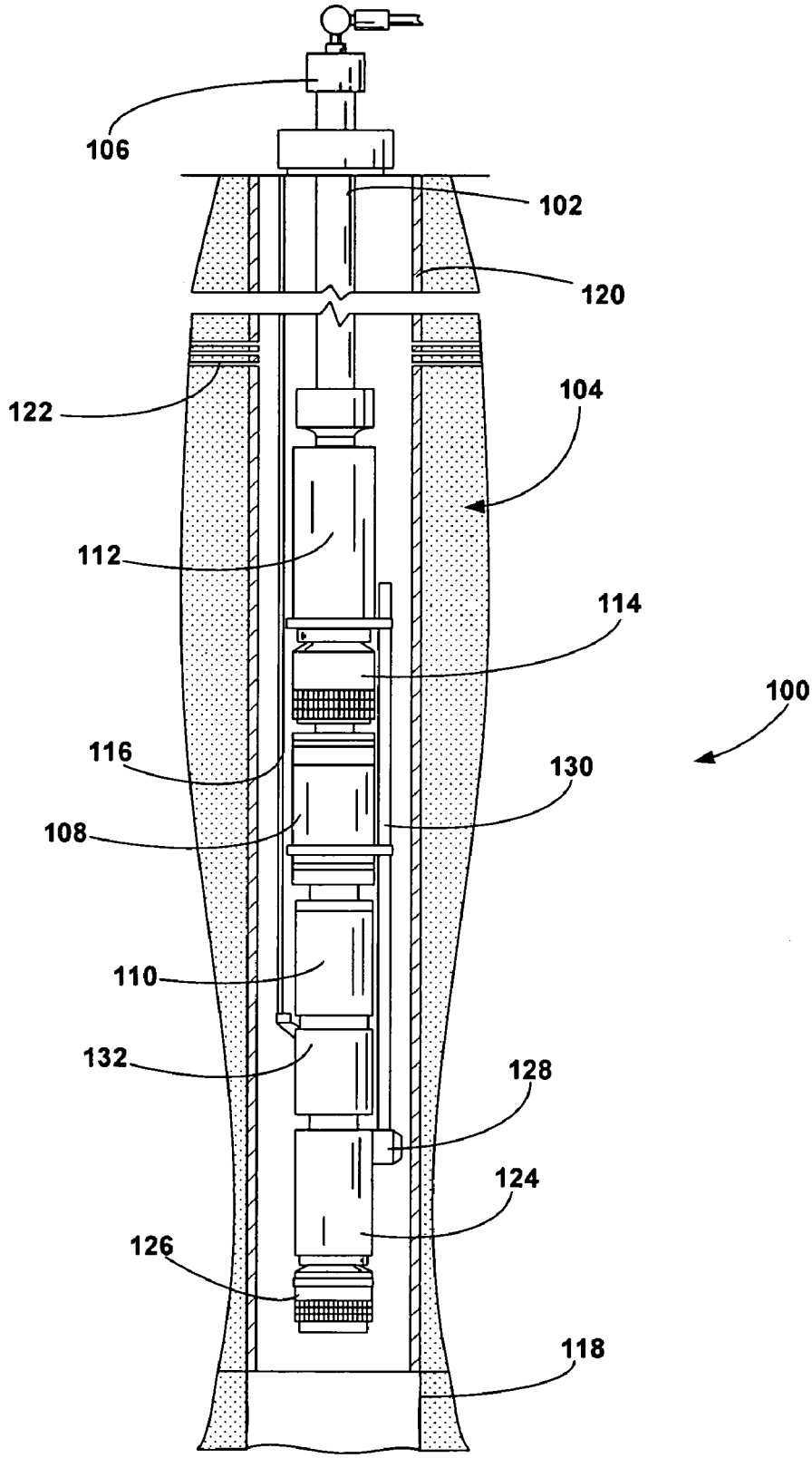
FIG. 2 depicts a submersible pumping system constructed in accordance with an alternate preferred embodiment of the present invention.

Typical electrical submersible motors (such as motor 110) employ three-phase power using one of several wiring configurations known in the art, such as a wye or delta configuration. In a preferred embodiment, the auxiliary adapter 132 includes a wye point connection 148 near the interface with the motor 110. The wye point connection 148 completes the electric circuit for driving the motor 110 when the auxiliary adapter 132 is attached to the motor 110, thereby providing the desired termination. The wye point connection 148 can be adapted to provide a termination for any desired wiring configuration used for powering the motor 110. Termination of the wiring connection can be accomplished at the motor 110 (as shown in FIG. 1), or alternatively in the auxiliary adapter 132 (as shown in FIG. 2).

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. An electric submersible pumping system for use in wellbore fluids, comprising:
   - a motor;
   - a production pump;
   - a seal section connected between the motor and production pump;
   - an auxiliary pump; and
   - an auxiliary adapter having a wye-point connector, wherein the auxiliary adapter is connected between the motor and the auxiliary pump, and wherein the auxiliary adapter further comprises a plurality of chambers and pistons that cooperatively seal the motor from wellbore fluids in the auxiliary pump while permitting lubricating oil in the motor to expand and contract during operation of the motor.

2. The electrical submersible pumping system of claim 1, further comprising a power cable that provides electrical power to the motor, wherein the power cable terminates at the wye-point connector on the auxiliary adapter.

3. An electric submersible pumping system for use in wellbore fluids, comprising:
   - a motor;
   - a production pump;
   - a seal section connected between the motor and production pump;
   - an auxiliary pump; and
   - an auxiliary adapter having a wye-point connector, wherein the auxiliary adapter is connected between the motor and the auxiliary pump, and wherein the auxiliary adapter comprises a thrust bearing.

4. An electric submersible pumping system for use in wellbore fluids, comprising:
   - a motor;
   - a production pump;
   - a seal section connected between the motor and production pump;
   - an auxiliary pump; and
   - an auxiliary adapter having a wye-point connector, wherein the auxiliary adapter is connected between the motor and the auxiliary pump, and wherein the auxiliary adapter further comprises:
     - a shaft, wherein the shaft transmits torque from the motor to the auxiliary pump; and
     - a plurality of mechanical seals connected to the shaft.

5. An electrical submersible pumping system comprising:
   - a motor;

a production pump disposed above the motor;

a seal section disposed between the production pump and the motor;

an auxiliary pump disposed below the motor; and an auxiliary adapter disposed between the motor and the auxiliary pump, wherein the auxiliary adapter comprises:

a plurality of chambers and pistons that cooperatively seal the motor from wellbore fluids in the auxiliary pump while permitting lubricating oil in the motor to expand and contract during operation of the motor;

a shaft;

a thrust bearing configured to limit the transfer of thrust transferred through the shaft; and a plurality of mechanical seals disposed about the shaft.

6. The electrical submersible pumping system of claim 5, wherein the auxiliary adapter further comprises a wye-point connector.

7. The electrical submersible pumping system of claim 6, further comprising a power cable that provides electrical power to the motor, wherein the power cable terminates at the wye-point connector on the auxiliary adapter.

8. An electric submersible pumping system for use in a wellbore, comprising:

a motor having lubricating oil;

a production pump disposed about the motor;

an upper seal section disposed between the motor and the production pump, wherein the upper seal section accommodates the expansion of the lubricating oil;

an auxiliary pump disposed below the motor, wherein the auxiliary pump is configured to pump fluids upward toward the production pump;

a lower seal section disposed between the auxiliary pump and the motor, wherein the lower seal section is configured to prevent the ingress of wellbore fluids into the motor from the auxiliary pump, and wherein the lower seal section includes a wye-point connector; and a power cable that provides electrical power to the motor wherein the power cable terminates at the wye-point connector on the lower seal section.

9. The electrical submersible pumping system of claim 8, wherein the lower seal section comprises a plurality of chambers and pistons that cooperatively seal the motor from wellbore fluids in the auxiliary pump while permitting lubricating oil in the motor to expand and contract during operation of the motor.

10. The electrical submersible pumping system of claim 8, wherein the lower seal section comprises a thrust bearing.

11. The electrical submersible pumping system of claim 8, wherein the lower seal section comprises:

a shaft, wherein the shaft transmits torque from the motor to the auxiliary pump; and a plurality of mechanical seals connected to the shaft.

* * * * *